US009186027B2

(12) United States Patent
Genn

(10) Patent No.: US 9,186,027 B2
(45) Date of Patent: Nov. 17, 2015

(54) ATTACHMENT FOR A CLEANING APPLIANCE

(75) Inventor: Stuart Lloyd Genn, Malmesbury (GB)

(73) Assignee: Dyson Technology Limited, Wiltshire (GB)

( * ) Notice: Subject to any disclaimer, the term of this patent is extended or adjusted under 35 U.S.C. 154(b) by 433 days.

(21) Appl. No.: 12/376,768

(22) PCT Filed: Jul. 16, 2007

(86) PCT No.: PCT/GB2007/002671

§ 371 (c)(1),
(2), (4) Date: Aug. 11, 2009

(87) PCT Pub. No.: WO2008/017801

PCT Pub. Date: Feb. 14, 2008

(65) Prior Publication Data

US 2010/0037425 A1 Feb. 18, 2010

(30) Foreign Application Priority Data

Aug. 8, 2006 (GB) ..... 0615684.8

(51) Int. Cl.
*A47L 9/02* (2006.01)

(52) U.S. Cl.
CPC ..... *A47L 9/02* (2013.01)

(58) Field of Classification Search
USPC ..... 15/414, 415.1, 416, 322, 417
See application file for complete search history.

(56) References Cited

U.S. PATENT DOCUMENTS

| | | | | |
|---|---|---|---|---|
| 3,952,362 | A | 4/1976 | Torii | |
| 4,694,529 | A | 9/1987 | Choiniere | |
| 5,502,870 | A | 4/1996 | Ragner et al. | |
| 2005/0050680 | A1 * | 3/2005 | Anderson et al. | 15/415.1 |

FOREIGN PATENT DOCUMENTS

| | | |
|---|---|---|
| DE | 2602969 | 7/1977 |
| DE | 4304681 | 8/1994 |
| DE | 20312836 | 2/2004 |
| GB | 2320889 | 7/1998 |
| GB | 2378643 | 2/2003 |
| GB | 2401310 | 11/2004 |
| JP | 7-47040 | 2/1995 |
| JP | 2005-245933 | 9/2005 |
| WO | WO-02/067747 | 9/2002 |

OTHER PUBLICATIONS

British Search Report dated Nov. 2, 2006 directed towards foreign application No. GB0615684.8; 1 page.

(Continued)

*Primary Examiner* — Dung Van Nguyen
(74) *Attorney, Agent, or Firm* — Morrison & Foerster LLP

(57) ABSTRACT

An attachment for a cleaning appliance includes a main body having a head and a passageway through which a fluid is able to flow. The head includes first and second suction openings, each of the first and second suction openings being arranged to engage with a surface to be cleaned. The first and second suction openings are in simultaneous communication with the passageway. By providing such an arrangement, both of the first and second suction openings are independently able to engage with a surface to be cleaned and a rotatable connection between the head and a neck is not required.

15 Claims, 6 Drawing Sheets

(56) References Cited

OTHER PUBLICATIONS

International Search Report and Written Opinion mailed on Aug. 11, 2007 directed towards counterpart international application No. PCT/GB2007/002671; 13 pages.

International Preliminary Report on Patentability dated Oct. 20, 2008 directed towards international application No. PCT/GB2007/002671; 7 pages.

* cited by examiner

ATTACHMENT FOR A CLEANING APPLIANCE

REFERENCE TO RELATED APPLICATIONS

This application is a national stage application under 35 USC 371 of International Application No. PCT/GB2007/002671, filed Jul. 16, 2007, which claims the priority of United Kingdom Application No. 0615684, filed Aug. 8, 2006, the contents of which prior applications are incorporated herein by reference.

FIELD OF THE INVENTION

The invention relates to an attachment for a cleaning appliance particularly, but not exclusively, for a vacuum cleaner.

BACKGROUND OF INVENTION

Attachments for vacuum cleaners are well known in the art. Vacuum cleaners are frequently sold with a range of attachments for different cleaning purposes. These attachments are usually fitted onto the end of a wand or hose of an upright or cylinder vacuum cleaner. For example, a vacuum cleaner may be provided with a brush tool for dusting surfaces, a stair tool for cleaning stairs, and a crevice tool for cleaning hard-to-reach areas which are difficult to access with larger attachments.

In order to clean effectively, it is important that a suction opening of an attachment is close to, or in contact with, a surface to be cleaned. Preferably, the whole of the suction opening should be in close proximity to the surface to be cleaned. If there is too great an air gap between the suction opening of the attachment and the surface to be cleaned, less of the air entering the suction opening will have passed across or through the surface to be cleaned. Therefore, less dirt and dust will be picked up and the cleaning performance of the vacuum cleaner will be reduced.

In order to reduce this problem, an attachment for a vacuum cleaner such as a stair tool is often provided with a rotatable connection located between the head of the tool and the connection part of the tool (which connects to the mouth of a wand or hose). The rotatable connection is commonly angled relative to the head or the connection part such that different angular orientations of the head with respect to the wand or hose can be achieved. This allows a user to clean more easily surfaces positioned at different angles.

Another example of an attachment having a rotatable connection is shown in GB 2 320 889. This document discloses a vacuum cleaner brush head assembly which has two suction openings arranged at right angles to one another. Each suction opening is arranged to allow a different cleaning operation to be performed. Rotation of the head relative to a neck opens an air conduit between one of the suction openings and the neck and closes another air conduit between the other of the suction openings and the neck. This means that the user can rotate the head relative to a neck of the assembly in order to select one of the two suction openings depending upon the cleaning operation required.

A disadvantage common to the prior art arrangements described above is that they require some form of rotatable connection in order to operate. A moveable connection requires a user to change manually the position of the head relative to the connection part when the user wishes to clean different surfaces. This is inconvenient for a user. Further, a user may have to handle a dirty and dusty vacuum cleaner accessory head which may be unpleasant, unhygienic and pose a health risk for allergy suffers. Further, movable parts are often more complicated to manufacture than a single, fixed part. Additionally, moving connections are often less reliable than a single fixed part and may be more prone to failure.

SUMMARY OF THE INVENTION

It is an object of the present invention to provide an attachment for a cleaning appliance which can be changed between cleaning modes more easily and simply than prior art arrangements.

The invention provides an attachment for a vacuum cleaner comprising a main body, the main body having a head, a neck and a passageway through which a fluid is able to flow, the head including first and second suction openings, each of the first and second suction openings being arranged to engage with a surface to be cleaned, the first and second suction openings being in simultaneous communication with the passageway, and the passageway extends through the neck, which is cylindrical and has a substantially constant inner diameter. By providing such an arrangement, both of the first and second suction openings are independently able to engage with a surface to be cleaned and a rotatable connection between the head and the neck is not required.

Preferably, each of the first and second suction openings is arranged to operate as a dirty air inlet when engaged with the surface to be cleaned and as an air bleed when remote from the surface to be cleaned. By providing first and second suction openings which are dimensioned to allow dirt and dust to pass therethrough and also to operate as an air bleed, effective cleaning of a surface can be achieved when either the first or the second suction opening engages the surface.

Preferably, the first and second suction openings are arranged such that when one of the first and second suction openings operates as a dirty air inlet, the other of the first and second suction openings operates as an air bleed. By providing such an arrangement, when one of the first and second suction openings is placed against a surface to be cleaned, it will allow dirt and dust from the surface to be cleaned to pass therethrough. At the same time, the other of the suction openings is able to function as an air bleed. The continuous provision of bled air reduces the force that is required by a user to push the tool along a surface and therefore improves the manoeuvrability of the attachment without hindering the ability of the attachment to pick up dirt and dust.

Preferably, the main body further comprises a neck having a longitudinal axis and the first suction opening operates either as a dirty air inlet or as an air bleed depending upon the angle of the longitudinal axis with respect to the surface to be cleaned. More preferably, the first suction opening operates as a dirty air inlet when the angle between the longitudinal axis and the surface to be cleaned is less than 45° and as an air bleed when the angle of the longitudinal axis with respect to the surface to be cleaned is 45° or more.

Preferably, the main body further comprises a neck having a longitudinal axis and the second suction opening operates either as a dirty air inlet or as an air bleed depending upon the angle of the longitudinal axis with respect to the surface to be cleaned. More preferably, the second suction opening operates as a dirty air inlet when the angle between the longitudinal axis and the surface to be cleaned is 45° or more and as an air bleed when the angle of the longitudinal axis with respect to the surface to be cleaned is less than 45°.

By varying the angle of the neck of the attachment, a user can place either the first or the second suction opening against a surface to be cleaned in order for the respective suction opening to function as a dirty air inlet.

Preferably, the first suction opening lies in a first plane and the second suction opening lies in a second plane and the first plane lies at an angle to the second plane. This arrangement allows one of the first and second suction openings preferentially to engage a surface to be cleaned. This arrangement allows a user to clean effectively surfaces at different angles without having to make any adjustments to the attachment such as, for example, rotating a connector.

More preferably, the first plane lies at an angle to the second plane which is in the range of 30 to 60°. This range of angles provides a useful difference in angle between the first suction opening and the second suction opening. This allows a user to clean easily surfaces which are at an angle to one another, for example a flight of stairs.

Preferably, the passageway includes a first suction conduit extending from the first suction opening into the main body and a second conduit extending from the second suction opening into the main body. By providing two suction conduits separate from one another, the airflow paths from the first suction opening into the main body and from the second suction opening into the main body can be kept distinct from one another inside the main body.

Alternatively, the first and second suction openings may open directly into the passageway.

In an embodiment, the first suction opening may be bounded on one side by a first lip and on the other side by a two-part partition which may extend from, or near from, the passageway towards the side walls of the attachment, to form a partial barrier between the first and second suction openings. The second suction opening may be bounded on one side by a second lip located on the opposite side of the head to the first lip. The other side of the second suction opening may be bounded by the two-part partition.

In an embodiment, the attachment may further comprise one or more air bleeds, for example side-edge air bleeds. In an embodiment the one or more air bleeds may be arranged on one or both of the side edges of the attachment. In a preferred embodiment an air bleed may be provided on each side wall of the second suction opening.

In a particular embodiment the first and/or second lip may further comprise at least one lint picker. In a preferred embodiment the first and/or second lip may further comprise a lint picker which may extend along at least a portion and preferably all or substantially all its length.

BRIEF DESCRIPTION OF THE DRAWINGS

Embodiments of the invention will now be described with reference to the accompanying drawings, in which.

DETAILED DESCRIPTION OF THE INVENTION

Figure 10:
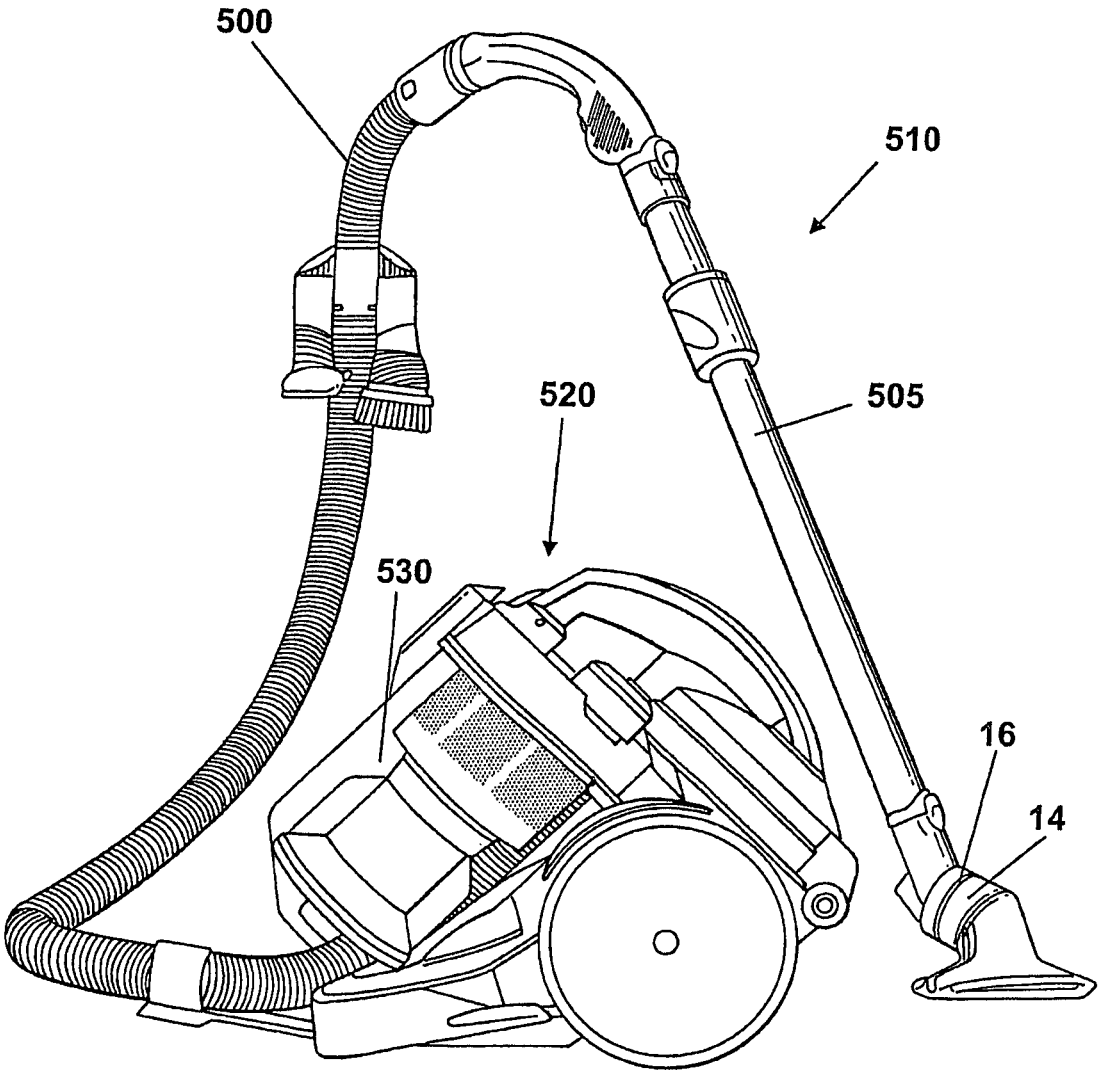
FIG. 10 shows an attachment for use with a cylinder type of vacuum cleaner.

FIGS. 1 to 5 show an attachment 10 according to a first embodiment of the present invention. Firstly referring to FIGS. 1 and 2, the attachment 10 has a main body 11 which includes a head 12 and a neck 14. The neck 14 is cylindrical and is dimensioned to connect to a mouth of a wand or hose 505 (as shown in FIG. 10) of a cleaning appliance, for example, a vacuum cleaner 510. The neck 14 includes an annular recess 16 which is arranged to lock against a part of the wand or hose 505 of the vacuum cleaner 510 in order to maintain the attachment 10 in a fixed relationship to the wand or hose 505. A flexible hose 500 connects the wand 505 to the main body 520 of the vacuum cleaner 510. A separator 530, such as a cyclonic separator or filter bag serves to separate dirt, dust and debris from the dirty airflow which is drawn into the main body 520. As can be seen in FIG. 10 the vacuum cleaner 510 may comprise a cylinder type vacuum cleaner but it may alternatively be an upright or stick type vacuum cleaner.

The head 12 is fixedly attached to the neck 14. The head 12 includes a first suction opening 18 and a second suction opening 20. The first suction opening 18 is bounded on one side by a first lip 22 and on another side by a partition 24. The second suction opening 20 is bounded on one side by a second lip 26 which is located on the opposite side of the head 12 to the first lip 22. The other side of the second suction opening 20 is bounded by the partition 24. The partition 24 separates the first suction opening 18 from the second suction opening 20.

Figure 1:
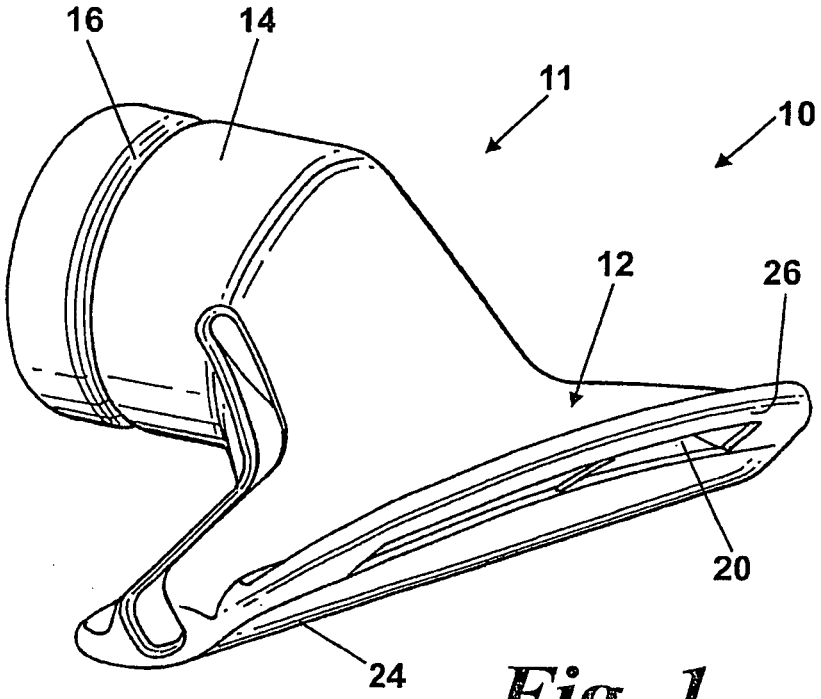
FIG. 1 shows a perspective view of a first embodiment of an attachment according to the present invention.
Figure 2:
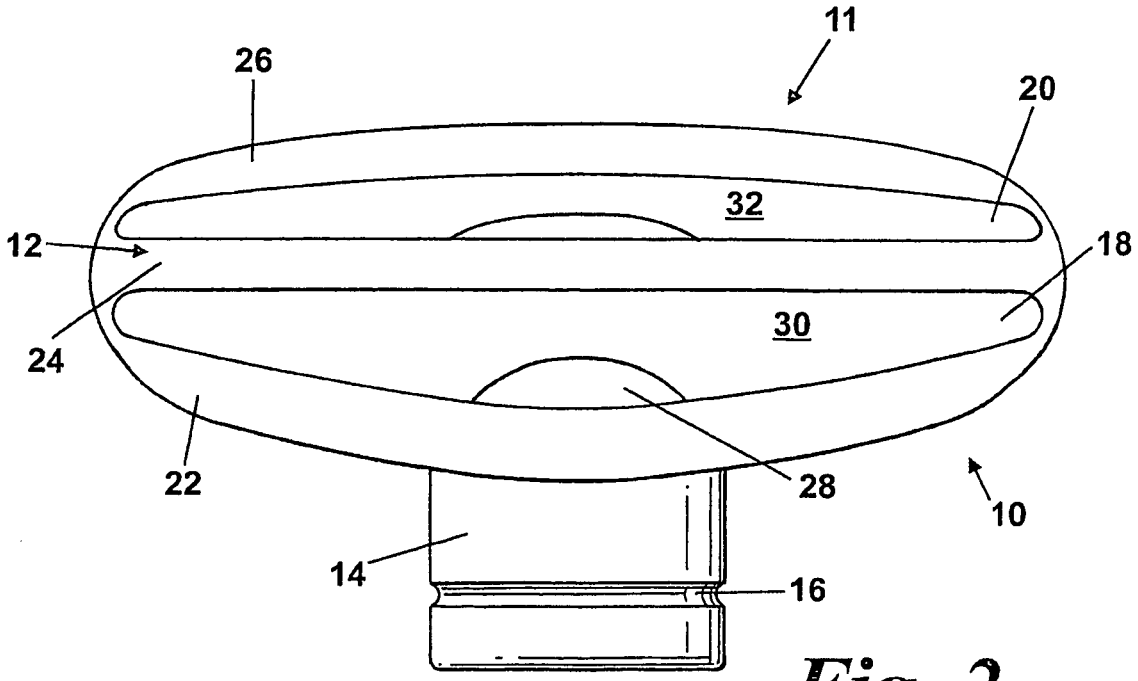
FIG. 2 shows an underneath view of the attachment of FIG. 1.
Figure 3:
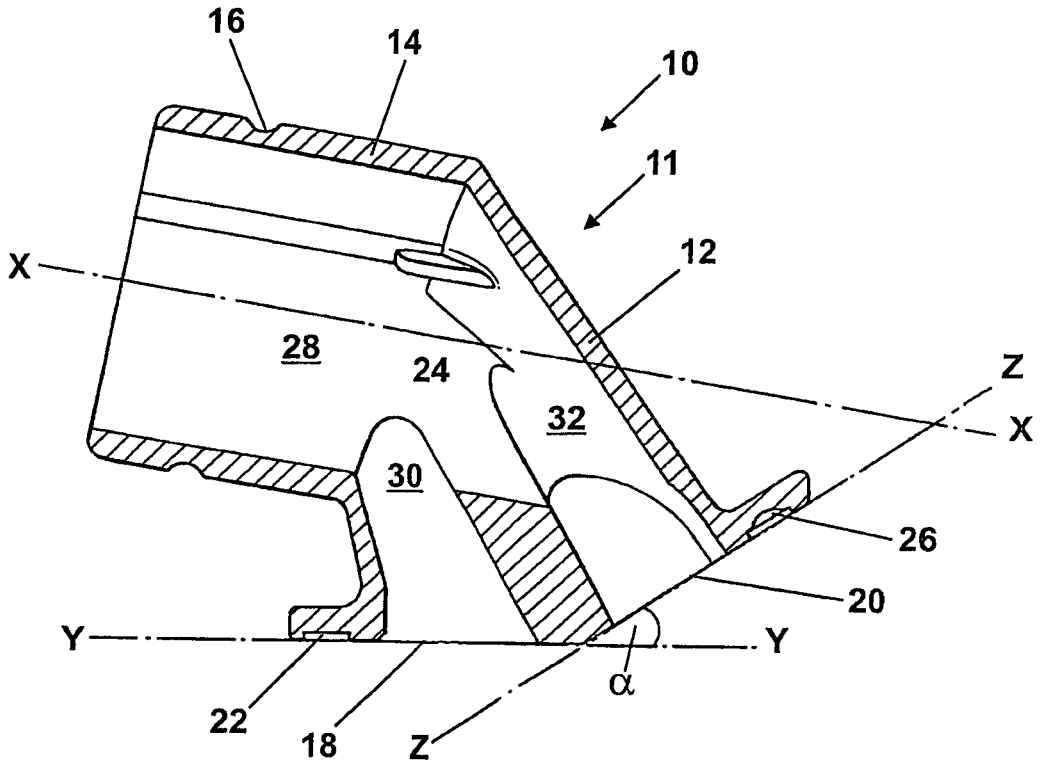
FIG. 3 shows a cross section through the side of the attachment of FIG. 1.

Turning now to FIG. 3, the main body 11 further includes a passageway 28. The passageway 28 extends through the main body 11 from the neck 14 to the first and second suction openings 18, 20. The first and second suction openings 18, 20 are in simultaneous communication with the passageway 28. By this is meant that both of the first and second suction openings 18, 20 are open to the passageway 28 at the same time. Expressed another way, the first and second suction openings are in permanent communication with one another via the passageway 28.

The partition 24 extends partially into the passageway 28 between the first and second suction openings 18, 20. The partition 24 divides the region of the passageway 28 adjacent the first and second suction openings 18, 20 into a first suction conduit 30 and a second suction conduit 32. Airflow paths are formed through the attachment 10. A first airflow path is formed through the attachment 10 from the first suction opening 18, along the first suction conduit 30 and the passageway 28 to the distal end of the neck 14.

A second airflow path is formed through the attachment 10 from the second suction opening 20, along the second suction conduit 32 and the passageway 28 to the same distal end of the neck 14.

Each of the first and second suction openings 18, 20 is of a suitable dimension to function as a dirty air inlet. By this is meant that the first and second suction openings 18, 20 are arranged such that the user can clean a surface efficiently and without undue burden. Additionally, the first and second suction openings 18, 20 are of a sufficient size and cross-sectional area to admit a flow of dirt- and dust-laden air from the surface to be cleaned without blocking easily.

Further, each of the first and second suction openings 18, 20 is of a suitable dimension to function as an air bleed. By this is meant that, when one of the first and second suction openings 18, 20 is placed against the surface to be cleaned in order to operate as a dirty air inlet, the other of the first and second suction openings 18, 20 is arranged to admit a quantity of air per unit time which is within a particular range. The quantity of air admitted through the bleed must be above a particular value such that, if the dirty air inlet becomes blocked, the vacuum cleaner can continue to operate correctly. Additionally, the quantity of air admitted must not exceed a maximum value otherwise the majority of the air drawn into the main body 12 of the attachment 10 will pass through the air bleed and not the dirty air inlet. This will decrease the amount of suction available at the dirty air inlet to clean a surface and reduce the efficiency of the cleaning operation. In this embodiment, the first and second suction openings 18, 20 are of equal cross-sectional area.

Additionally, the dimensions of the first and second suction conduits 30, 32 are suitable to allow both of the first and second suction openings 18, 20 to function as dirty air inlets or as air bleeds. In this embodiment, the parts of the first and second suction conduits 30, 32 remote from the first and second suction openings 18, 20 are of the same cross-sectional area.

The neck 14 has an axis X-X (FIG. 3) which lies coaxially with the cylindrical part of the neck 14. The first suction opening 18 lies in a first plane Y-Y and the second suction opening 20 lies in a second plane Z-Z. The first plane Y-Y is arranged at an angle $\alpha$ to the second plane Z-Z. In this embodiment, the angle $\alpha$ is 45°.

In use, the attachment 10 can be connected to a wand or hose 505 of a vacuum cleaner 510. This is done by inserting the cylindrical neck 14 into the mouth of a wand or hose 505. The annular recess 16 will lock and secure against a part of the wand or hose 505 and hold the attachment 10 in a fixed relationship to the wand or hose 505. The wand or hose can then be connected to the vacuum cleaner 510. The vacuum cleaner 510 includes a motor and fan unit to generate an airflow. The airflow is drawn in through the first and second suction openings 18, 20 and passes along the first and second suction conduits 30, 32, the passageway 28 and the wand or hose 505 to the vacuum cleaner main body 520. The vacuum cleaner 510 further includes some form of separating apparatus 530 in order to separate dirt and dust from the airflow. This may take the form of, for example, a cyclonic separator. After dirt and dust has been separated from the airflow by the separating apparatus 530, the cleaned air is exhausted from the vacuum cleaner 510.

Figure 4:
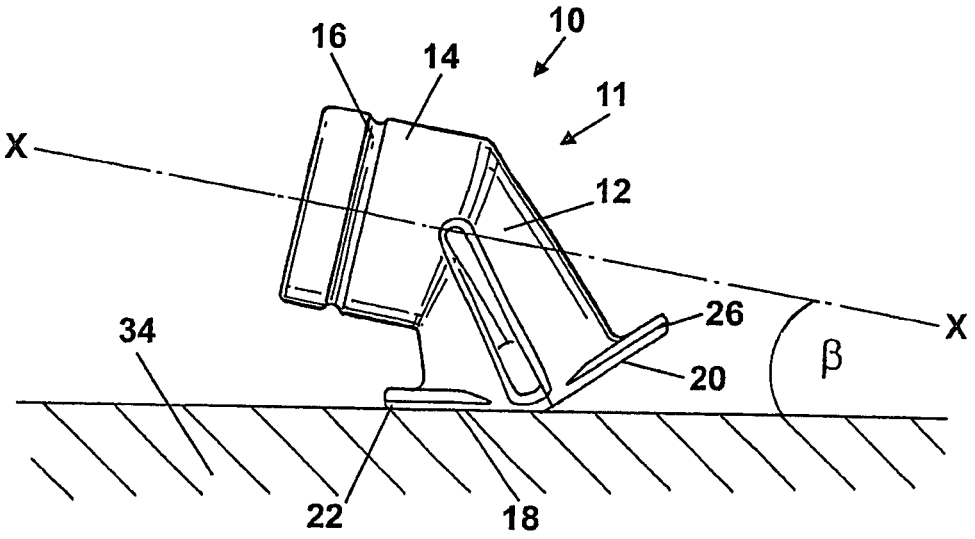
FIG. 4 shows a side view of the attachment of FIG. 1 in use in a first position.
Figure 5:
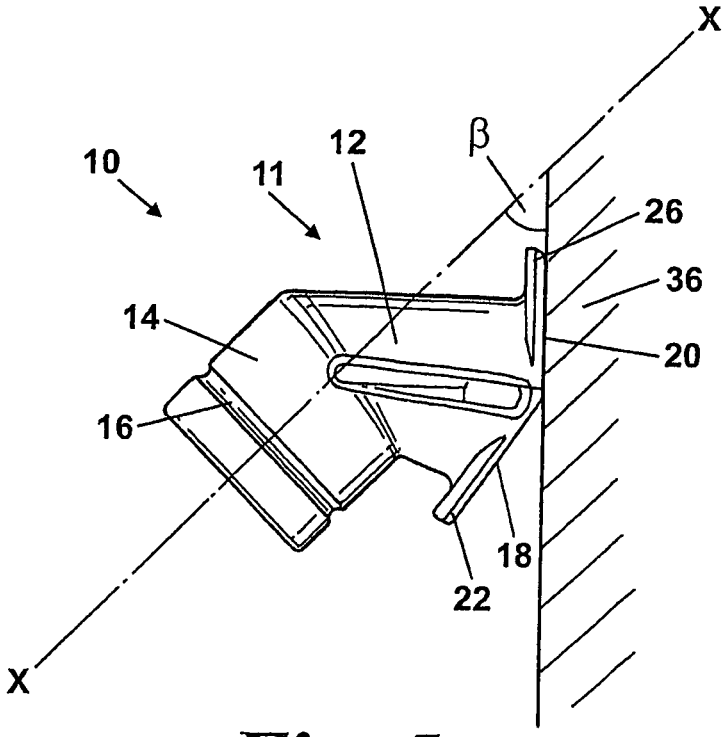
FIG. 5 shows a side view of the attachment of FIG. 1 in use in a second position.
Figure 6:
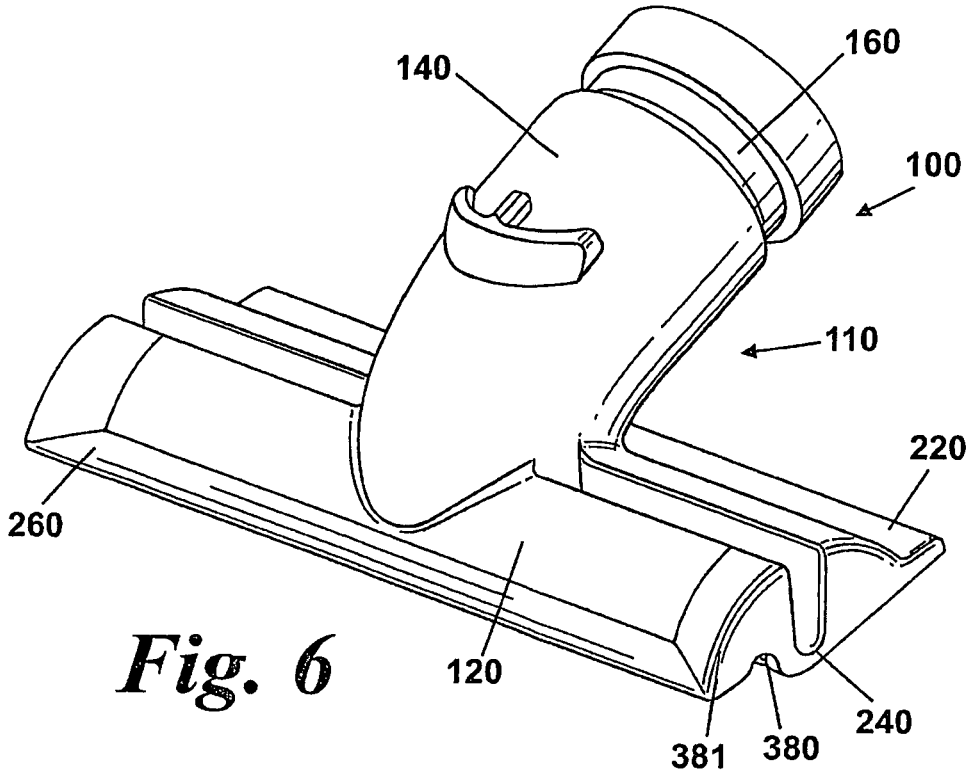
FIG. 6 shows a perspective view of a second embodiment of the attachment according to the present invention.

In use, the user will move the wand or hose in order to bring the attachment 10 close to a surface to be cleaned. FIGS. 4 and 5 show alternative positions of the attachment 10 in use. FIG. 4 shows the attachment 10 in a first position. In the first position in FIG. 4, the first suction opening 18 is operating as a dirty air inlet and is engaged with a first surface 34 to be cleaned. In the first position, the second suction opening 20 operates as an air bleed. The operation of the air bleed reduces the tendency of the suction force at the dirty air inlet to suck the attachment 10 down onto the surface 34 to be cleaned. Therefore, the air bleed through the second suction opening 20 makes the attachment 10 easier to manoeuvre across the first surface 34 to be cleaned. Further, the air bleed will ensure that sufficient airflow is maintained through the attachment 10 to the wand or hose so that the vacuum cleaner can operate correctly. For example, in the case of a vacuum cleaner including a cyclonic separator, an airflow in the region of 13 liters per second (1/s) is required in order to allow the cyclonic separator to function correctly and to keep the motor cool.

In the first position, the angle $\beta$ between the longitudinal axis of the neck and the first surface 34 to be cleaned is less than 45°. Since the wand or hose 505 will normally form a straight extension of the neck 14, the longitudinal axis of the neck 14 will correspond to the longitudinal axis of the hose or wand.

FIG. 5 shows the attachment 10 in use in a second position. In the second position, the second suction opening 20 is operating as a dirty air inlet and is engaged with a second surface 36 to be cleaned. The second surface 36 to be cleaned is arranged perpendicular to the first surface 34 to be cleaned. The first and second surfaces 34, 36 to be cleaned may lie adjacent one another as is the case in, for example, a flight of stairs. In the second position, the first suction opening 18 operates as an air bleed. The air bleed reduces the tendency of the suction force at the dirty air inlet to suck the attachment 10 down onto the surface 36 to be cleaned and allows the vacuum cleaner to operate correctly as described above. In this position, the angle $\beta$ between the longitudinal axis X-X of the neck 14 and the surface 36 to be cleaned is 45°.

By providing first and second suction openings 18, 20 as described above, the user is able to vacuum surfaces at different angles without needing to adjust or change the attachment 10. This results in greater convenience for a user because, for example, a user will be able to clean a flight of stairs by simply changing the angle of the wand or hose with respect to the surface to be cleaned. Further, the attachment 10 according to the invention is more hygienic to use. The attachment 10 comprises fewer parts and will have improved reliability.

FIGS. 6 to 10 show a second embodiment of an attachment 100 according to the present invention. Firstly referring to FIGS. 6 and 7, the attachment 100 has a main body 110 which includes a head 120 and a neck 140. The neck 140 is cylindrical and is dimensioned to connect to a mouth of a wand or hose 505 of a cleaning appliance, for example, a vacuum cleaner 510 as shown in FIG. 10. The neck 140 includes an annular recess 160 which is arranged to lock against a part of the wand or hose 505 of the vacuum cleaner 510 in order to maintain the attachment 100 in a fixed relationship to the wand or hose 505.

Figure 7:
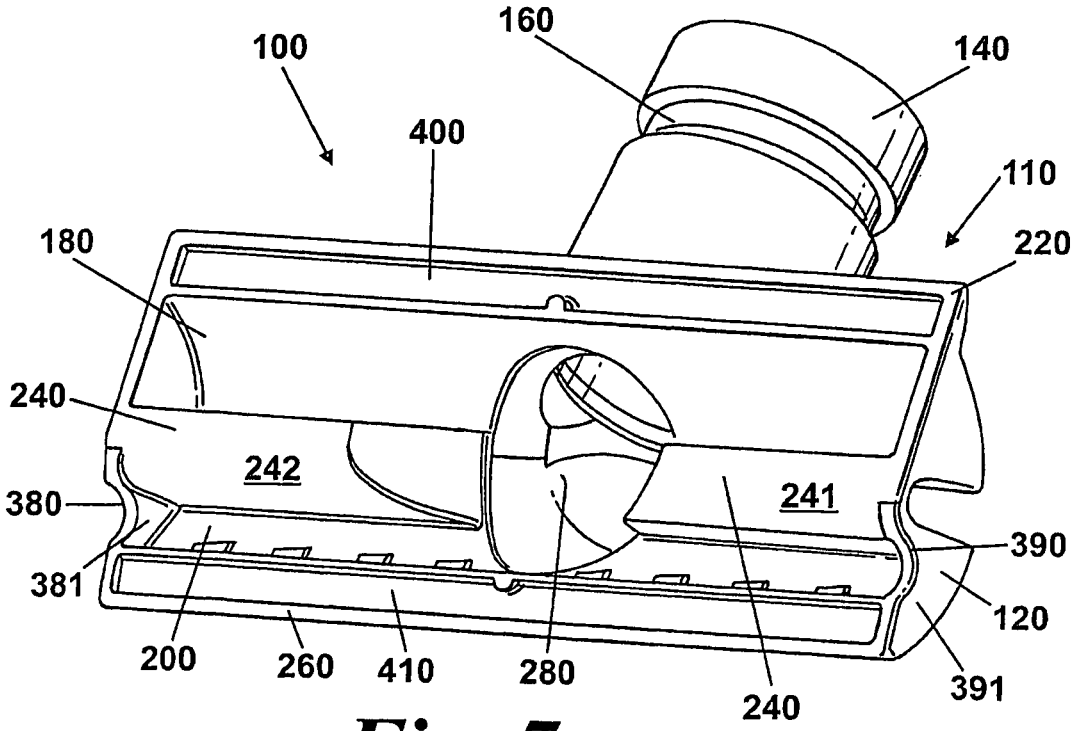
FIG. 7 shows a perspective underneath view of the attachment of FIG. 6.

The head 120 is fixedly attached to the neck 140. The head 120 includes a first suction opening 180 and a second suction opening 200. The first suction opening 180 is bounded on one side by a first lip 220 and on another side by a partition 240 which extends substantially parallel to the first lip 220 but with a gap over the passageway 280. As can be seen in FIG. 7, the partition 240 is formed from a first partition 241 and a second partition 242 which in each case extends partially across the head 120 between the first and second suction openings 180, 200.

The second suction opening 200 is bounded on one side by a second lip 260 which is located on the opposite side of the head 120 to the first lip 220. The other side of the second suction opening 200 is partially bounded by the partition 240. The partition 240 therefore partially separates the first suction opening 180 from the second suction opening 200.

Figure 8:
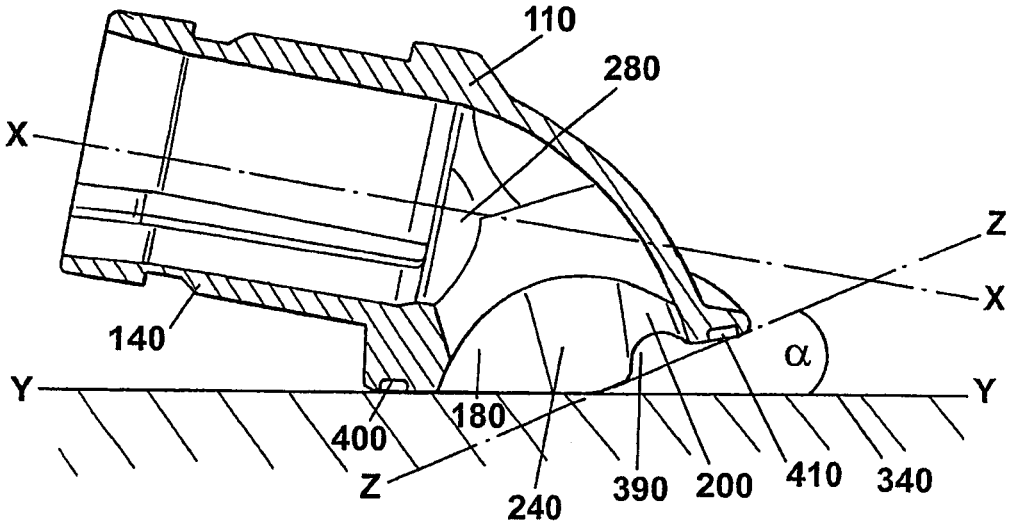
FIG. 8 shows a cross section through the side of the attachment of FIG. 6 in use in a first position.
Figure 9:
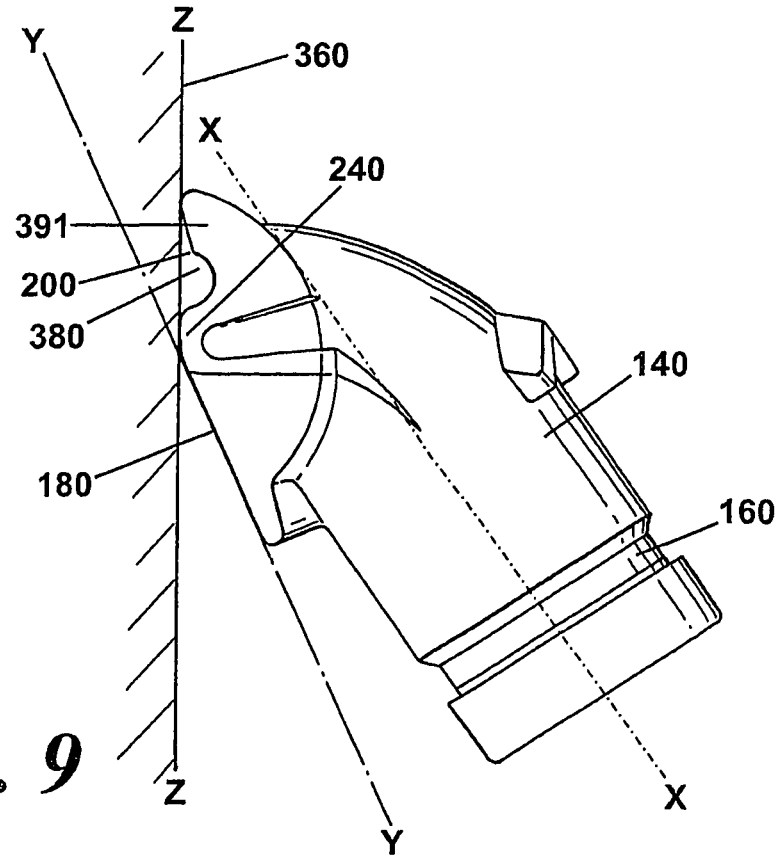
FIG. 9 shows a side view of the attachment of FIG. 6 in use in a second position.

Turning now to FIGS. 8 and 9, a passageway 280 extends through the main body 110 from the neck 140 to the first and second suction openings 180, 200. The first and second suction openings 180, 200 therefore lead directly into the passageway 280 and are in simultaneous communication with it. By this is meant that both of the first and second suction openings 180, 200 are open to the passageway 280 at the same time. Expressed another way, the first and second suction openings are in permanent communication with one another via the passageway 280.

As for the first embodiment, each of the first and second suction openings 180, 200 are of a suitable dimension to function as a dirty air inlet. By this is meant that the first and second suction openings 180, 200 are arranged such that the user can clean a surface efficiently and without undue burden. Additionally, the first and second suction openings 180, 200 are of a sufficient size and cross-sectional area to admit a flow of dirt- and dust-laden air from the surface to be cleaned without blocking easily.

Further, each of the first and second suction openings 180, 200 are of a suitable dimension to function as an air bleed. By this is meant that, when one of the first and second suction openings 180, 200 is placed against the surface to be cleaned in order to operate as a dirty air inlet, the other of the first and second suction openings 180, 200 is arranged to admit a quantity of air per unit time which is within a particular range. The quantity of air admitted through the bleed must be above a particular value such that, if the dirty air inlet becomes blocked, the vacuum cleaner can continue to operate correctly. Additionally, the quantity of air admitted must not exceed a maximum value otherwise the majority of the air drawn into the main body 120 of the attachment 100 will pass through the air bleed and not the dirty air inlet. This will decrease the amount of suction available at the dirty air inlet to clean a surface and reduce the efficiency of the cleaning operation. In this embodiment, the first and second suction openings 180, 200 are of equal cross-sectional area. Preferably the first and second suction openings are elongate. In a preferred embodiment the axes which extend along the length of each of the openings are substantially perpendicular to the longitudinal axis of the neck.

The neck 140 has an axis X-X (FIG. 8) which lies coaxially with the cylindrical part of the neck 140. The first suction opening 180 lies in a first plane Y-Y and the second suction opening 200 lies in a second plane Z-Z. The first plane Y-Y is arranged at an angle $\alpha$ to the second plane Z-Z.

In use, the attachment 100 can be connected to a wand or hose of a vacuum cleaner 510 as shown in FIG. 10, in the same manner as described in relation to the first embodiment. During use airflow is drawn in through the first and second suction openings 180, 200 and passes along the passageway 280 and a wand or hose 505 of the vacuum cleaner 510 to which it is attached and into a separating apparatus 530 located in the main body 520 of the vacuum cleaner 510.

In use, the user will move the wand or hose 505 in order to bring the attachment 100 close to a surface to be cleaned. FIG. 8 shows the attachment 100 in a first position. In this first position the first suction opening 180 is operating as a dirty air inlet and is engaged with a first surface 340 to be cleaned. In this first position, the second suction opening 200 operates as an air bleed. The operation of the air bleed reduces the tendency of the suction force at the dirty air inlet to suck the attachment 100 down onto the surface 340 to be cleaned. Therefore, the air bleed through the second suction opening 200 makes the attachment 100 easier to manoeuvre across the first surface 340 to be cleaned. Further, the air bleed will ensure that sufficient airflow is maintained through the attachment 100 to the wand or hose so that the vacuum cleaner can operate correctly. For example, in the case of a vacuum cleaner including a cyclonic separator, an airflow in the region of 13 liters per second (1/s) is required in order to allow the cyclonic separator to function correctly and to keep the motor cool.

FIG. 9 shows the second position. In the second position, the second suction opening 200 is operating as a dirty air inlet and is engaged with a second surface 360 to be cleaned. In the second position, the first suction opening 180 operates as an air bleed. The air bleed reduces the tendency of the suction force at the dirty air inlet to suck the attachment 100 down onto the surface 360 to be cleaned and allows the vacuum cleaner to operate correctly as described above.

By providing first and second suction openings 180, 200 as described above, the user is able to vacuum surfaces at different angles without needing to adjust or change the attachment 100. This results in greater convenience for a user because, for example, a user will be able to clean a flight of stairs by simply changing the angle of the wand or hose with respect to the surface to be cleaned. Further, the attachment 100 according to the invention is more hygienic to use. The attachment 100 comprises fewer parts and will have improved reliability.

As can be seen in FIGS. 6 to 9 the attachment also further comprises a pair of side-edge air bleeds 380, 390. These side-edge air bleeds 380, 390 are provided on each side wall 381, 391 of the second suction opening 200. Such additional air bleeds 380, 390 are advantageously positioned to pick up dirt and dust, for example along the edge of a room.

In a particular embodiment the first and second lip 220, 260 have lint pickers 400, 410. In the embodiment shown the lint pickers 400, 410 run along the entire length of the respective lips 220, 260. This arrangement is advantageous since it results in better pickup along the entire width of the head. This arrangement has surprisingly been found to be possible due to the partition 240 reducing overall friction between the attachment 100 and a surface 340, 360 on which it is used. Previously it has not been possible to have lint pickers across the entire, or substantially the entire width of the head because the attachment would be very difficult to manoeuvre across a surface to be cleaned, due to high friction between the lint pickers and the surface. However, the present attachment 100 is advantageous since only one of the lips 220, 260 will be in contact with the surface to be cleaned at any one time, the other surface in contact with the floor being the partition 240, which preferably has a smooth surface, for example by being free from lint pickers. Thus because of the partition 240, it is possible to have lint pickers 400, 410 running along the entire, or substantially the entire length of the respective lips 220, 260.

The invention is not limited to the features of the specific embodiment described above. Variations will be apparent to the person skilled in the art. For example, more than two suction openings may be provided. Further, the dimensions and arrangements of the suction openings may be varied. The suction openings need not be of equal cross-sectional area. What is important is that at least two of the suction openings are each capable of functioning as a dirty air inlet and also as an air bleed.

The suction openings may be arranged at angles to one another which are different from those in the embodiment described above. Additionally, the suction openings may be arranged at angles to the longitudinal axis of the neck which are different from those shown in the embodiment.

Further, the attachment of the present invention may have a rotatable or pivotable connection between the head and the neck in order to allow a greater range of angles and positions of the head relative to the neck to be achieved, or for the above angles to be variable by a user.

The attachment of the present invention need not have a neck. A wand or hose could simply be attached to the head of the attachment. Further, the head need not take the form of a stair tool as described in the specific embodiment above. Other configurations are possible, for example, a brush tool or a comb.

The cleaning appliance suitable for use with the attachment may be a different type of vacuum to that described above. The vacuum cleaner may, for example, incorporate separating apparatus such as a porous bag or a filter system instead of a cyclonic separator. Further, a cleaning appliance other than a vacuum cleaner could be used, for example, a carpet cleaner or a wet and dry machine.

The invention claimed is:

1. An attachment for a vacuum cleaner comprising a main body, the main body having a head, a neck and a passageway through which a fluid is able to flow, the head including one or more air bleeds provided on one or more side walls of the head, and first and second suction openings, each of the first and second suction openings being arranged to engage with a surface to be cleaned, wherein the first and second suction openings are in simultaneous communication with the passageway, and the passageway extends through the neck, which is cylindrical and has a substantially constant inner diameter.

2. An attachment according to claim 1, wherein each of the first and second suction openings is arranged to operate as a dirty air inlet when engaged with the surface to be cleaned and as an air bleed when remote from the surface to be cleaned.

3. An attachment according to claim 2, wherein the first and second suction openings are arranged such that when one of the first and second suction openings operates as a dirty air inlet, the other of the first and second suction openings operates as an air bleed.

4. An attachment according to claim 2 or 3, wherein the neck has a longitudinal axis, and the first suction opening is configured to operate either as a dirty air inlet or as an air bleed depending upon the angle of the longitudinal axis with respect to the surface to be cleaned.

5. An attachment according to claim 4, wherein the first suction opening operates as a dirty air inlet when the angle between the longitudinal axis and the surface to be cleaned is less than 45° and as an air bleed when the angle of the longitudinal axis with respect to the surface to be cleaned is 45° or more.

6. An attachment according to claim 2 or 3, wherein the neck has a longitudinal axis, and the second suction opening operates either as a dirty air inlet or as an air bleed depending upon the angle of the longitudinal axis with respect to the surface to be cleaned.

7. An attachment according to claim 6, wherein the second suction opening is configured to operate as a dirty air inlet when the angle between the longitudinal axis and the surface to be cleaned is 45° or more and as an air bleed when the angle of the longitudinal axis with respect to the surface to be cleaned is less than 45 °.

8. An attachment according to claim 1, 2 or 3, wherein the first suction opening lies in a first plane and the second suction opening lies in a second plane and the first plane lies at an angle to the second plane.

9. An attachment according to claim 8, wherein the first plane lies at an angle to the second plane which is in the range of 30 to 60°.

10. An attachment according to claim 1, 2 or 3, wherein the first and second suction openings are of substantially the same cross-sectional area.

11. An attachment according to claim 1, 2 or 3, wherein the first and second suction openings are separated by a partition.

12. An attachment according to claim 11 wherein the partition forms a partial barrier between the first and second suction openings.

13. An attachment according to claim 1, 2 or 3, wherein the first suction opening is bounded on one side by a first lip and the second suction opening is bounded on one side by a second lip located on the opposite side of the head to the first lip.

14. An attachment according to claim 13, further comprising one or more lint pickers which run along the substantially the entire length of the first or second lip.

15. A vacuum cleaner comprising the attachment according to claim 1, 2 or 3.

* * * * *